US008604401B2

(12) United States Patent
Cole

(10) Patent No.: US 8,604,401 B2
(45) Date of Patent: Dec. 10, 2013

(54) DEEP DISH MICROWAVE HEATING CONSTRUCT

(75) Inventor: Lorin R. Cole, Larsen, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 413 days.

(21) Appl. No.: 12/952,559

(22) Filed: Nov. 23, 2010

(65) Prior Publication Data

US 2011/0132903 A1 Jun. 9, 2011

Related U.S. Application Data

(60) Provisional application No. 61/267,924, filed on Dec. 9, 2009.

(51) Int. Cl.
*H05B 6/64* (2006.01)
*H05B 6/80* (2006.01)
*B65D 81/34* (2006.01)

(52) U.S. Cl.
USPC ..... 219/730; 219/728; 219/732; 426/107

(58) Field of Classification Search
USPC ..... 219/728–735, 762; 426/234, 241, 243, 426/107, 122–124; 99/DIG. 14; 428/34.2, 428/137, 209
See application file for complete search history.

(56) References Cited

U.S. PATENT DOCUMENTS 2,944,725 A 7/1960 Hayes
4,192,443 A 3/1980 McLaren
4,192,540 A 3/1980 Oliff
4,210,124 A 7/1980 Hertel et al.
4,283,427 A 8/1981 Winters et al.
4,505,391 A 3/1985 Kuchenbecker
4,592,914 A 6/1986 Kuchenbecker
4,705,929 A 11/1987 Atkinson
4,775,771 A 10/1988 Pawlowski
4,801,774 A 1/1989 Hart (Continued)

FOREIGN PATENT DOCUMENTS

EP 0 451 530 A2 10/1991
FR 745 013 5/1933

(Continued)

OTHER PUBLICATIONS

International Search Report and Written Opinion dated Aug. 30, 2011 for PCT/US2010/057747.

(Continued)

*Primary Examiner* — Quang Van
(74) *Attorney, Agent, or Firm* — Womble Carlyle Sandridge & Rice, LLP

(57) ABSTRACT

A microwave heating construct for preparing a food item having a periphery that is desirably browned and/or crisped includes a substantially planar base and a plurality of side walls extending upwardly from a periphery of the base. The base and side walls define an interior space for receiving the food item. The base includes a plurality of movable portions for being moved out of the plane of the base into the interior space towards the periphery of the food item. A microwave energy interactive material may be joined to at least a portion of the base including the movable portions. The microwave energy interactive material may be operative for converting at least a portion of impinging microwave energy into heat.

31 Claims, 5 Drawing Sheets

(56) References Cited

U.S. PATENT DOCUMENTS

| | | | |
|---|---|---|---|
| 4,865,921 | A | 9/1989 | Hollenberg |
| 4,877,932 | A | 10/1989 | Bernstein |
| 4,890,439 | A | 1/1990 | Smart |
| 4,916,280 | A | 4/1990 | Havette |
| 4,936,935 | A | 6/1990 | Beckett |
| 4,943,456 | A | 7/1990 | Pollart et al. |
| 4,963,424 | A | 10/1990 | Beckett |
| 5,002,826 | A | 3/1991 | Pollart et al. |
| 5,039,364 | A | 8/1991 | Beckett et al. |
| 5,117,078 | A | 5/1992 | Beckett |
| 5,118,747 | A | 6/1992 | Pollart et al. |
| 5,213,902 | A | 5/1993 | Beckett |
| 5,221,419 | A | 6/1993 | Beckett |
| 5,247,149 | A | 9/1993 | Peleg |
| 5,260,537 | A | 11/1993 | Beckett |
| 5,266,386 | A | 11/1993 | Beckett |
| RE34,683 | E | 8/1994 | Maynard |
| 5,340,436 | A | 8/1994 | Beckett |
| 5,354,973 | A | 10/1994 | Beckett |
| 5,410,135 | A | 4/1995 | Pollart et al. |
| 5,412,187 | A | 5/1995 | Walters et al. |
| 5,424,517 | A | 6/1995 | Habeger |
| 5,519,195 | A | 5/1996 | Keefer |
| 5,530,231 | A | 6/1996 | Walters et al. |
| 5,544,806 | A | 8/1996 | Anderson |
| 5,628,921 | A | 5/1997 | Beckett |
| 5,672,407 | A | 9/1997 | Beckett |
| 5,688,427 | A | 11/1997 | Gallo |
| 5,759,422 | A | 6/1998 | Schmelzer |
| 5,800,724 | A | 9/1998 | Habeger |
| 6,114,679 | A | 9/2000 | Lai |
| 6,150,646 | A | 11/2000 | Lai et al. |
| 6,204,492 | B1 | 3/2001 | Zeng et al. |
| 6,251,451 | B1 | 6/2001 | Zeng |
| 6,359,272 | B1 | 3/2002 | Sadek |
| 6,414,290 | B1 | 7/2002 | Cole |
| 6,433,322 | B2 | 8/2002 | Zeng et al. |
| 6,455,827 | B2 | 9/2002 | Zeng |
| 6,552,315 | B2 | 4/2003 | Zeng et al. |
| 6,677,563 | B2 | 1/2004 | Lai |
| 6,717,121 | B2 | 4/2004 | Zeng |
| 6,765,182 | B2 | 7/2004 | Cole |
| 7,514,659 | B2 | 4/2009 | Lafferty |
| 8,008,609 | B2 | 8/2011 | Noyelle et al. |
| 8,071,924 | B2 | 12/2011 | Lafferty |
| 8,183,506 | B2 | 5/2012 | Fitzwater |
| 8,217,325 | B2 | 7/2012 | Russell et al. |
| 2004/0149746 | A1 | 8/2004 | Hoese et al. |
| 2006/0049190 | A1 | 3/2006 | Middleton |
| 2007/0087090 | A1 | 4/2007 | Russell |
| 2007/0228036 | A1 | 10/2007 | Noyelle et al. |
| 2008/0023469 | A1 | 1/2008 | Fitzwater |
| 2008/0035634 | A1 | 2/2008 | Zeng et al. |
| 2008/0041925 | A1 | 2/2008 | Cambay |
| 2009/0120929 | A1 | 5/2009 | Lafferty |
| 2009/0218338 | A1 | 9/2009 | Futzwater |
| 2009/0230126 | A1 | 9/2009 | Fitzwater |
| 2010/0038359 | A1 | 2/2010 | Laubhan et al. |
| 2010/0055260 | A1 | 3/2010 | Sweet |
| 2010/0059511 | A1 | 3/2010 | Gowens et al. |
| 2010/0072197 | A1* | 3/2010 | Neff et al. ..... 219/730 |
| 2010/0178396 | A1 | 7/2010 | Lafferty et al. |
| 2010/0213192 | A1 | 8/2010 | Middleton et al. |
| 2012/0000905 | A1 | 1/2012 | Noyelle et al. |
| 2012/0100265 | A1 | 4/2012 | Lafferty |
| 2012/0187114 | A1 | 7/2012 | Fitzwater |
| 2012/0193351 | A1 | 8/2012 | Russell et al. |

FOREIGN PATENT DOCUMENTS

| | | | |
|---|---|---|---|
| FR | 961 269 | | 5/1950 |
| GB | 925 971 | | 5/1963 |
| GB | 2 127 677 | A | 4/1984 |
| GB | 2 150 534 | A | 7/1985 |
| JP | 08-253236 | A | 10/1996 |
| JP | 2008-127043 | A | 6/2008 |
| KR | 10-1998-0048713 | A | 9/1998 |
| KR | 20-2008-0001059 | U | 5/2008 |
| WO | WO 93/19566 | A1 | 9/1993 |
| WO | WO 2006/076501 | A1 | 7/2006 |
| WO | WO 2007/033183 | A1 | 3/2007 |
| WO | WO 2007/123611 | A1 | 11/2007 |
| WO | WO 2007/127371 | A2 | 11/2007 |
| WO | WO 2008/014377 | A2 | 1/2008 |
| WO | WO 2008/033396 | A2 | 3/2008 |
| WO | WO 2008/052096 | A1 | 5/2008 |
| WO | WO 2008/115272 | A2 | 9/2008 |
| WO | WO 2008/144343 | A2 | 11/2008 |
| WO | WO 2010/019758 | A2 | 2/2010 |
| WO | WO 2010/081059 | A2 | 7/2010 |
| WO | WO 2011/071690 | A2 | 6/2011 |

OTHER PUBLICATIONS

PCT/US2006/035503—International Search Report and Written Opinion, Dec. 21, 2006, Graphic Packaging International, Inc.

PCT/US2007/082477—International Search Report and Written Opinion, Mar. 10, 2008, Graphic Packaging International, Inc.

PCT/US2007/081462—International Search Report and Written Opinion, Sep. 29, 2008, Graphic Packaging International, Inc.

PCT/US2010/020580—International Search Report and Written Opinion, Aug. 19, 2010, Graphic Packaging International, Inc.

PCT/US2010/020580—International Preliminary Report on Patentability, Jul. 12, 2011, Graphic Packaging International, Inc.

PCT/US2010/057747—International Preliminary Report on Patentability, Jun. 12, 2012, Graphic Packaging International, Inc.

* cited by examiner

DEEP DISH MICROWAVE HEATING CONSTRUCT

CROSS-REFERENCE TO RELATED APPLICATION

This application claims the benefit of U.S. Provisional Application No. 61/267,924, filed Dec. 9, 2009, which is incorporated by reference herein in its entirety.

TECHNICAL FIELD

This disclosure relates to constructs or apparatuses for heating or cooking a microwavable food item. In particular, this disclosure relates to various constructs or apparatuses for heating or cooking a food item in a microwave oven, where the food item has a surface that is desirably browned and/or crisped.

BACKGROUND

Microwave ovens provide a convenient means for heating a variety of food items, including sandwiches and other bread and/or dough-based products such as pizzas and pies. However, microwave ovens tend to cook such items unevenly and are unable to achieve the desired balance of thorough heating and a browned, crisp crust. As such, there is a continuing need for improved materials, packages, and constructs that provide the desired degree of heating, browning, and/or crisping of various food items in a microwave oven.

SUMMARY

This disclosure is directed generally to various microwave heating constructs, blanks for forming such constructs, and methods of using such constructs. The various constructs may be particularly suitable for heating a somewhat thicker or taller food item having a periphery that is desirably browned and/or crisped, and optionally also a bottom surface that is desirably browned and/or crisped, for example, a deep dish pizza or fruit pie.

The various constructs may include one or more features (e.g., microwave energy interactive elements) for altering the effect of microwave energy on the food item. In one example, the various constructs and/or blanks may include a susceptor, which generally comprises a thin layer of microwave energy interactive material (generally less than about 100 angstroms in thickness, for example, from about 60 to about 100 angstroms in thickness, and having an optical density of from about 0.15 to about 0.35, for example, about 0.21 to about 0.28) that tends to absorb at least a portion of impinging microwave energy and convert it to thermal energy (i.e., heat). Susceptors are typically used to enhancing the heating, browning, and/or crisping of the surface of a food item. However, other microwave energy interactive elements may be used.

In one exemplary embodiment, the construct may include a susceptor on one or more side walls for browning and/or crisping the periphery of the food item. In another exemplary embodiment, the construct may include movable portions that bring a susceptor into closer proximity with the periphery of the food item. In still another exemplary embodiment, the construct may include a susceptor "ring" for surrounding the periphery of the food item. Countless other possibilities are contemplated.

The construct may be formed at least partially from a disposable material, for example, paperboard.

Other features, aspects, and advantages of the present invention will be apparent from the following description and accompanying figures.

BRIEF DESCRIPTION OF THE DRAWINGS

The description refers to the accompanying schematic drawings in which like reference characters refer to like parts throughout the several views, and in which.

DESCRIPTION

Various aspects of the invention may be understood further by referring to the figures. For purposes of simplicity, like numerals may be used to describe like features. It will be understood that where a plurality of similar features are depicted, not all of such features necessarily are labeled on each figure. It also will be understood that the various components used to form the constructs may be interchanged. Thus, while only certain combinations are illustrated herein, numerous other combinations and configurations are contemplated hereby.

Figure 1A:
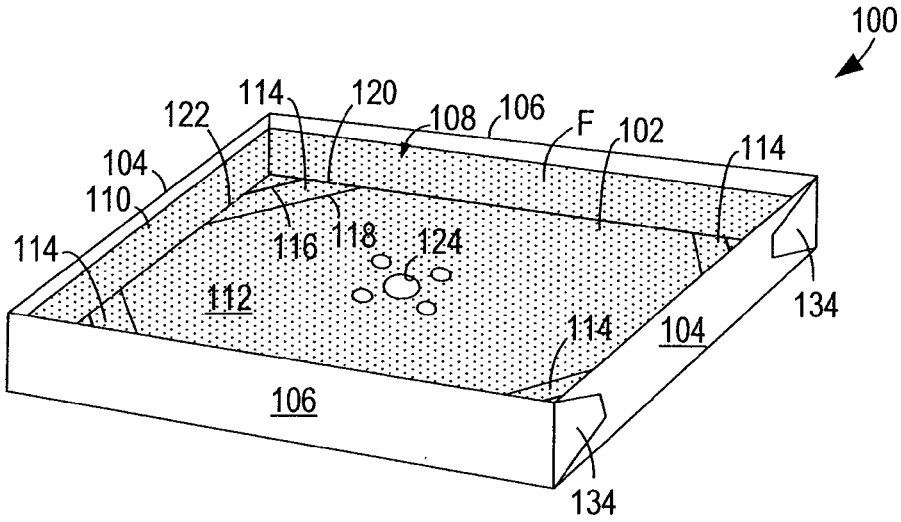
FIG. 1A is a schematic perspective view of an exemplary microwave heating construct.

FIG. 1A schematically depicts an exemplary microwave heating construct 100 (e.g., a tray) for heating a deep dish food item, for example, a pizza or pie. In this example, the construct 100 is generally square in shape. However, differently shaped constructs may be used.

The construct 100 includes a substantially planar base or base panel 102, and a first pair of side walls or panels 104 and a second pair of side walls or panels 106 extending upwardly from a peripheral edge or periphery of the base 102. The base 102 and side walls 104, 106 define an interior space 108 for receiving a food item having a periphery and/or bottom that is desirably browned and/or crisped.

One or more microwave energy interactive elements, for example, a susceptor 110 (shown schematically with stippling), may overlie and/or be joined to (or mounted on) all or a portion of the base 102 and/or side walls 104, 106. The susceptor 110 may be supported on a microwave energy transparent substrate 112, for example, a polymer film. The outermost surface of the polymer film 112 may define at least a portion of a food-contacting surface 112 of the construct 100. Other microwave energy interactive elements may be used alone or in combination with the susceptor 110, as will be discussed further below.

Figure 1B:
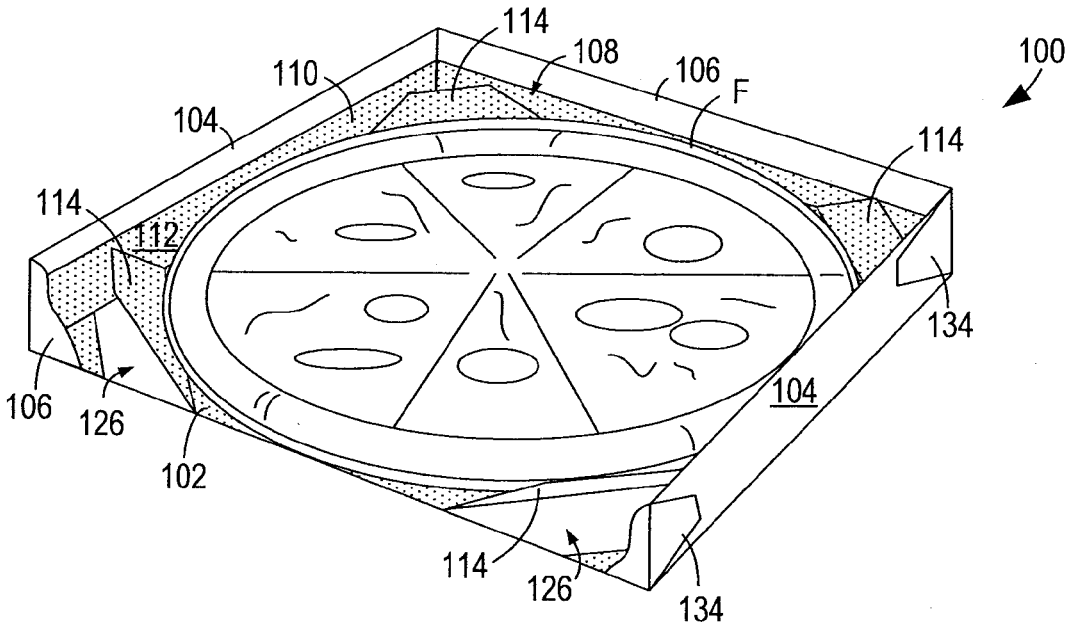
FIG. 1B is a schematic, partially cutaway, perspective view of the exemplary microwave heating construct of FIG. 1A, in use with a food item.

In this example, the susceptor 110 overlies substantially the entire base 102 and a portion of the walls 104, 106. However, in other embodiments, the susceptor 110 may overlie the base 102 only or the side walls 104, 106 only. Where used, the height of the susceptor 110 along the walls 104, 106 may be selected to closely match the height of the sides or periphery of food item, such that the susceptor 110 extends upwardly to be adjacent to the periphery of the food item F (FIG. 1B).

As shown in FIG. 1A, the base 102 includes a plurality of movable portions 114 for being moved out of the plane of the base 102 into the interior space 108 towards the periphery of the food item F. In this example, the construct 100 includes four movable portions 114 proximate to each corner of the base 102, with each movable portion 114 extending between pairs of adjacent side walls 104, 106 of the square-shaped construct 100. However, different numbers and configurations of movable portions 114 are contemplated.

Each movable portion 114 is defined by at least partially by a pair of lines of disruption 116, 118 (e.g., oblique lines of disruption, only one of each of which is labeled in FIG. 1A) extending substantially between a pair of adjacent side walls 104, 106. In one example, the first line of disruption 116 may comprise a cut (e.g., cut line, slit, or cutout) and the second line of disruption 118 may comprise a fold line. However, countless other possibilities are contemplated, as will be discussed further below.

The movable portions 114 of the base 102 may each be defined further by transverse and longitudinal lines of disruption 120, 122 (only one of each of which is labeled in FIG. 1A) extending substantially between respectively adjacent endpoints of the first line of disruption 116 and the second line of disruption 118. In this example, lines of disruption 120, 122 comprise tear lines (e.g., cut-space lines). However, other lines of disruption may be used, as will be discussed further below. Further, in this example, tear lines 120, 122 generally lie along the peripheral edge or periphery of the base 102. However, in other embodiments, tear lines 120, 122 may be spaced from the peripheral edge of the base 102.

If desired, the base 102 may also include one or more venting apertures 124 for carrying moisture away from the food item. In the illustrated embodiment, the construct 100 includes a first aperture substantially centered within the base 102, and four apertures positioned around the first aperture. However, other numbers and arrangements of apertures 124 may be used. Alternatively or additionally, it is contemplated that the side walls 104, 106 may include one or more apertures.

As shown in FIG. 1B (in which one of side walls 106 is partially cut away), to use the microwave heating construct 100 according to one exemplary method, a food item F may be placed on the base 102 within the interior space 108. The movable portions 114 of the base 102 may be activated by grasping each movable portion 114 along the respective cut 116, tearing along tear lines 120, 122 (where needed), and folding the movable portion 114 along the respective fold line 118 to bring the susceptor 110 of the movable portions 114 into closer proximity with the peripheral portions of the food item F generally facing the corners of the construct 100.

Upon sufficient exposure to microwave energy, the susceptor 110 converts at least a portion of the impinging microwave energy into thermal energy, which then can be transferred to the bottom surface and sides of the food item F to enhance browning and/or crisping of the food item F. The portions of the susceptor 110 overlying the movable portions 114 provide improved heating, browning, and/or crisping of the adjacent peripheral areas of the food item F, which might otherwise be spaced to far from the susceptor 110 on the walls 104, 106 to be sufficiently heated, browned, and/or crisped.

Figure 1C:
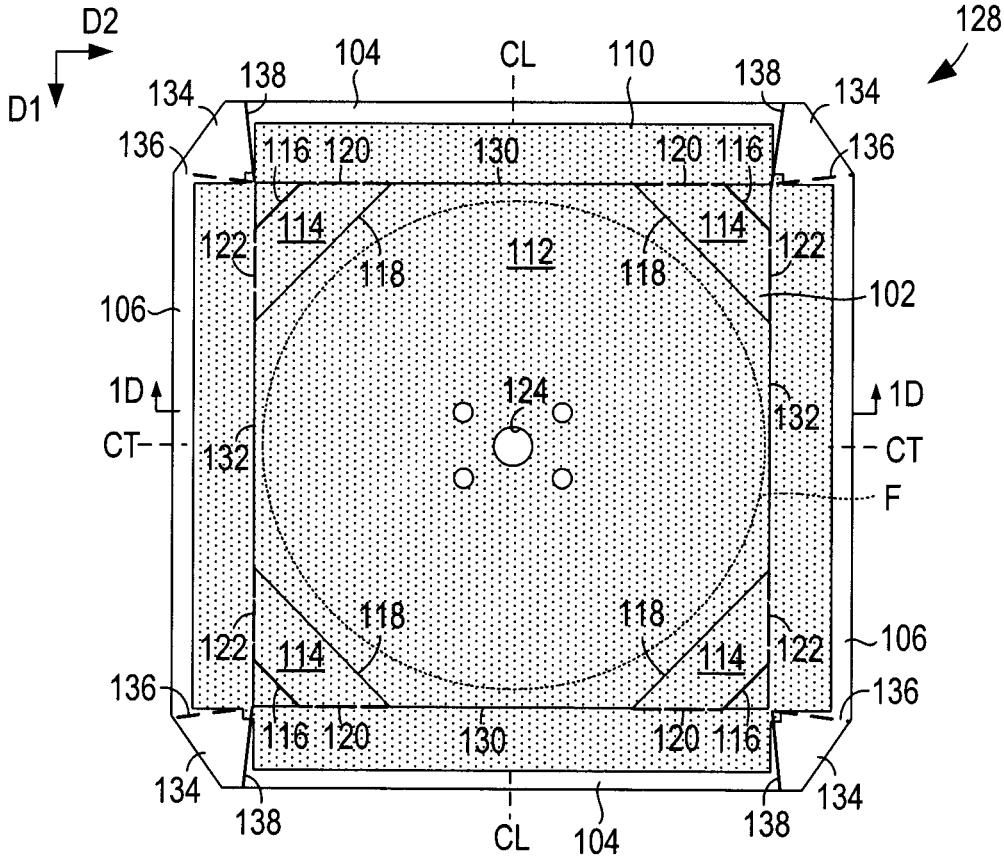
FIG. 1C is a schematic top plan view of one side of an exemplary blank for forming the construct of FIG. 1A, with a food item thereon.

As the food item F heats, water vapor and other gases trapped beneath the food item F may be carried away from the food item through the venting apertures 124 in the base 102 (as indicated schematically with arrows in FIG. 1C). As a result, the food item F may be browned and/or crisped more effectively. It will be appreciated that the apertures 124 may be sized and configured to provide the desired degree of venting needed for a particular food item. For example, where less venting is needed, smaller venting apertures 124 can be used. Conversely, where additional venting is needed, the apertures 124 can be larger or more apertures can be used. Additionally, when the movable portions 114 of the base 102 are moved towards the interior space 108, the movable portions 114 are struck from the base 102, thereby defining a plurality of venting openings 126 extending through the base 102. Such openings 126 may likewise allow of moisture away from the food item to enhance browning and/or crisping of the food item F.

If desired, the construct 100 also may be used to contain the food item F within the interior space 108 prior to use. This both potentially minimizes the dimension of the packaging and provides additional protection of the food item during shipping and handling. In such a case, the user would simply need to remove any overwrap from the food item prior to heating.

FIG. 1C depicts a schematic top plan view of an exemplary blank 128 that may be used to form the construct 100 of FIG. 1A. The blank 128 generally includes a plurality of panels joined along lines of disruption, for example, fold lines, fold lines, tear lines, score lines, or any other lines of weakening or disruption. The blank 128 and each of the various panels generally has a first dimension, for example, a length, extending in a first direction, for example, a longitudinal direction, D1, and a second dimension, for example, a width, extending in a second direction, for example, a transverse direction, D2. It will be understood that such designations are made only for convenience and do not necessarily refer to or limit the manner in which the blank is manufactured or erected into the construct. The blank 128 may be symmetric or nearly symmetric about a longitudinal centerline CL and a transverse centerline CL. Therefore, certain elements in the drawing figures may have similar or identical reference numerals to reflect the whole or partial symmetry.

As shown in FIG. 1C, the blank 128 includes a base panel 102 dimensioned for receiving a food item, for example, a pizza, sandwich, or other food item F (the periphery of which is shown schematically with dashed lines in FIG. 1B). A first pair of side panels (or side wall panels) 104 extends from a first pair of substantially parallel peripheral edges of the base panel 102 along respective transverse lines of disruption, for example, fold lines 130. A second pair of side panels (or side wall panels) 106 extends from a second pair of substantially parallel peripheral edges of the base panel 102 along respective longitudinal lines of disruption, for example, fold lines 132, such that fold lines 130, 132 are substantially perpendicular to one another. In this example, the side panels 104, 106 are substantially trapezoidal in shape, with the narrower "leg" or "base" of each trapezoidal panel 104, 106 defining the peripheral edges of the base panel 102 and the wider "leg" or "base" of each panel 104, 106 defining a portion of a peripheral edge of the blank 128. However, other shapes are contemplated hereby.

End flaps 134 extend from opposed longitudinal ends of each side panel 106 along respective oblique fold lines 136. The end flaps 134 are separated from the ends of the respectively adjacent side panels 104 by respective cuts 138.

As shown in FIG. 1C, the blank 128 includes a plurality of lines of disruption that collectively define movable portions 114 of the base panel 102. In this example, each movable portion 114 is defined by a pair of oblique lines of disruption 116, 118 (e.g., first and second lines of disruption) that extend substantially between fold lines 130, 132. Line of disruption 116 may generally be a breachable line of disruption, that is, a cut, slit, cutout, tear line, cut-space line, or the like, that is breached (i.e., separated along) or intended to be breached. Line of disruption 118 may be a non-breachable line of disruption, for example, a score line, fold line, cut-score line, cut-space line, or the like that is intended not to be breached. Other possibilities are contemplated.

Each movable portion 114 is further defined by a third line of disruption 120, for example, a transverse tear line, and a fourth line of disruption 122, for example, a longitudinal tear line respectively extending substantially between adjacent ends of the first line of disruption 116 and the second line of disruption 118. In this example, transverse and longitudinal tear lines 120, 122 are substantially collinear with, and respectively interrupt, fold lines 130, 132. However, in other embodiments, tear lines 120, 122 may be spaced inwardly from fold lines 130, 132. Additionally, it will be appreciated that tear lines 120, 122 may comprise any breachable line of disruption, for example, a cut, slit, cutout, tear line, cut-space line, or the like, that allows the movable portion 114 to be hinged along line of disruption 118. Further, it will be noted that in the illustrated embodiment, lines of disruption 116, 118 are generally parallel to one another, such that each movable portion 114 is substantially trapezoidal in shape. However, differently configured lines of disruption and differently shaped movable portions may be used.

Still viewing FIG. 1C, the base panel 102 also may include a plurality of apertures 124. In this example, the blank 128 includes a first aperture 124 substantially centered within the base panel 102 and four apertures 124 positioned around the first aperture. However, other numbers and configurations of apertures 124 are contemplated.

A microwave energy interactive element 110 (shown schematically with stippling), for example, a susceptor, optionally may overlie all or a portion of the various panels of the blank 128. In the illustrated example, the susceptor 110 overlies substantially all of the base panel 102 (including the movable portions 114) and a portion of each of the side panels 104, 106. However, in other embodiments, the susceptor 110 may overlie the base panel 102 only, one or more of panels 104, 106 only, or any combination thereof. Additionally, other microwave energy interactive elements may be used, as will be discussed further below.

Figure 1D:
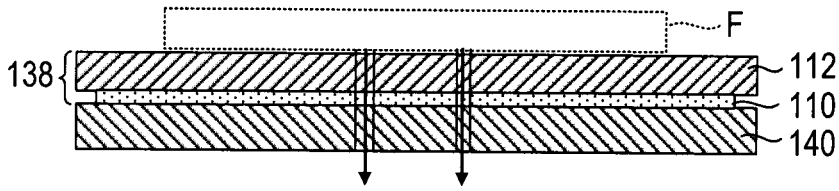
FIG. 1D is a schematic cross-sectional view of the blank of FIG. 1C, taken along a line 1D-1D.

As shown in schematic cross-sectional view in FIG. 1D, the susceptor 110 (or other microwave energy interactive element) may be supported on a microwave energy transparent substrate 112, for example, a polymer film, thereby collectively forming a "susceptor film" 138. The outermost surface of the polymer film 112 may define at least a portion of the food-contacting surface 112 of the blank 128 and construct 100. The susceptor film 138 may be supported on and/or joined to a paperboard base layer 140 (or other suitable base layer) using any suitable technique, for example, using a layer of adhesive (not shown).

To form the construct 100 from the blank 118 according to one exemplary method, panels 104, 106 may be folded along respective fold lines 130, 132 out of the plane of the base panel 102 towards the food-contacting surface 112. End flaps 134 may be folded inwardly along oblique fold lines 136 and joined to the exterior surface of panels 104 as shown in FIG. 1A using an adhesive or using or any other suitable chemical or mechanical fastening means. The construct 100 may be used as described above.

FIGS. 2A-4B schematically depict several exemplary variations of the microwave heating apparatus 100 and blank 128 of FIGS. 1A-1D. The various apparatuses 200, 300, 400 and blanks 228, 328 include features that are similar to the apparatus 100 and blank 128 shown in FIGS. 1A-1D, except for variations noted and variations that will be understood by those of skill in the art. For simplicity, the reference numerals of similar features are preceded in the figures with a "2" (FIGS. 2A and 2B), "3" (FIGS. 3A and 3B), or "4" (FIGS. 4A and 4B) instead of a "1".

Figure 2A:
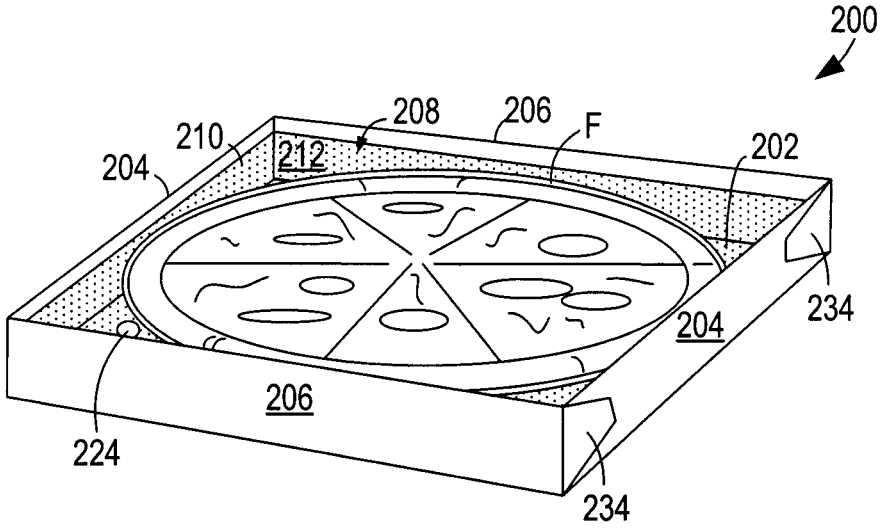
FIG. 2A is a schematic perspective view of another exemplary microwave heating construct, containing a food item.
Figure 2B:
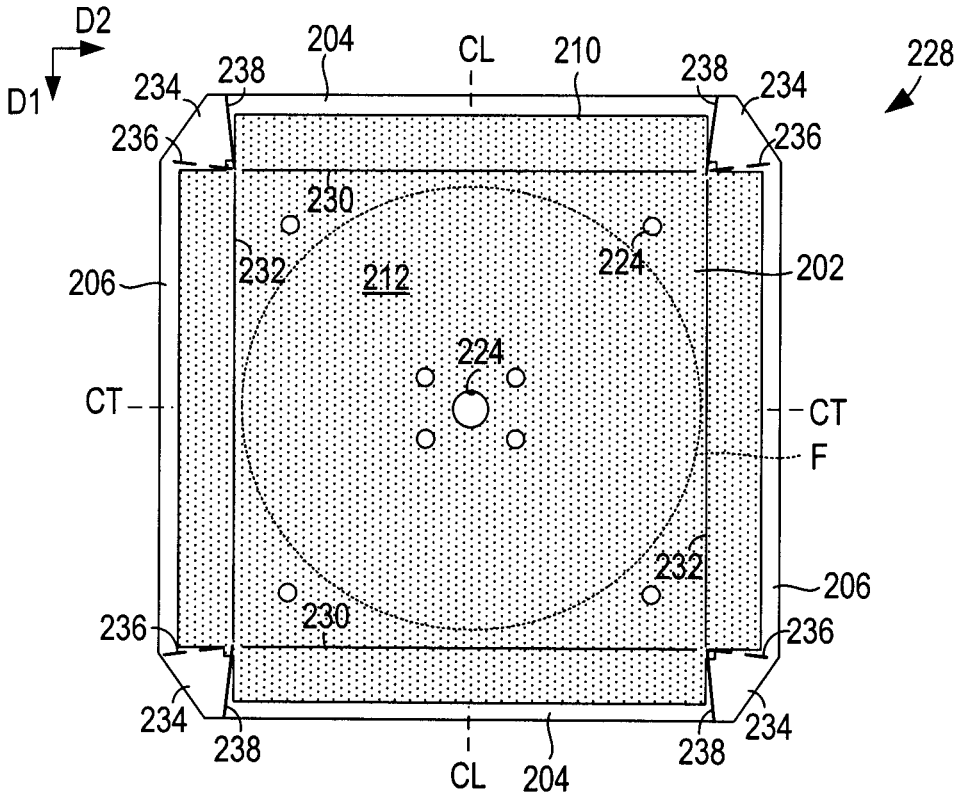
FIG. 2B is a schematic top plan view of one side of an exemplary blank for forming the construct of FIG. 2A.

In the exemplary construct 200 and blank 228 of FIGS. 2A and 2B, the movable portions 114 of the base 102 of the construct 100 of FIG. 1A are omitted and additional venting apertures 224 are provided. In particular, the construct 200 includes four additional venting apertures 224, with one venting aperture proximate to each corner of the base 202. However, other possible configurations of apertures may be used.

Figure 3A:
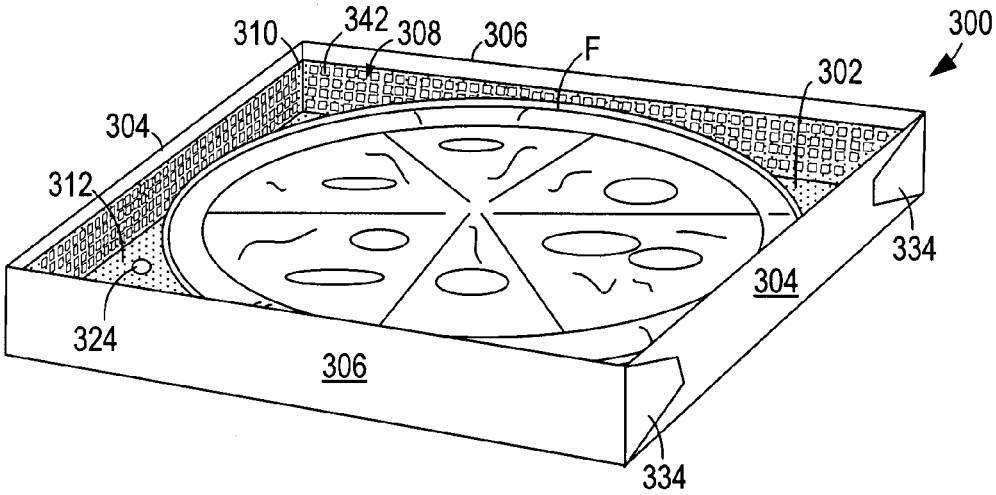
FIG. 3A is a schematic perspective view of yet another exemplary microwave heating construct, containing a food item.
Figure 3B:
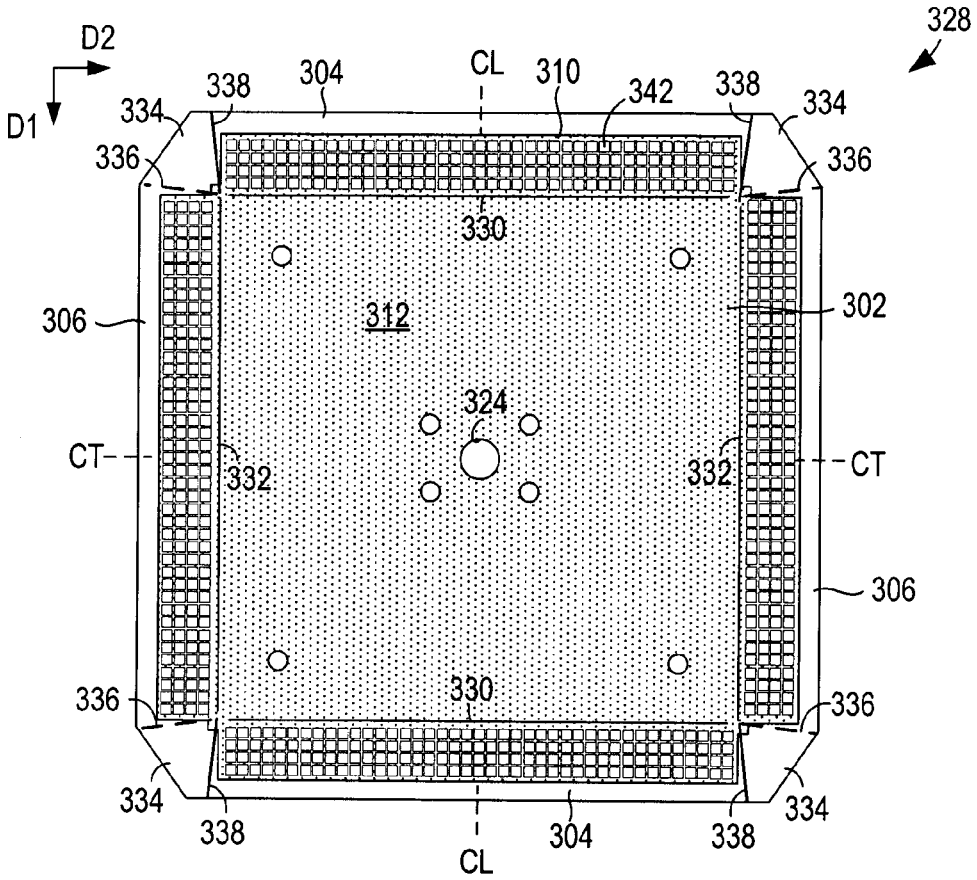
FIG. 3B is a schematic top plan view of one side of an exemplary blank for forming the construct of FIG. 3A.

The exemplary construct 300 and blank 328 of FIGS. 3A and 3B are similar to the construct 200 and blank 228 of FIGS. 2A and 2B, except that the susceptor 310 on the side walls and blank circumscribes (i.e., surrounds or includes) a plurality of microwave energy transparent areas 342 for allowing the passage of microwave energy therethrough. Such areas may be used to increase the amount of bulk heating and/or to decrease the amount of browning and/or crisping of the sides of the food item F. In this example, each of the microwave energy transparent areas 342 has a substantially square shape such that the susceptor has a grid-like appearance. However, any configuration of microwave energy transparent areas may be used, as needed or desired for a particular heating application.

Figure 4A:
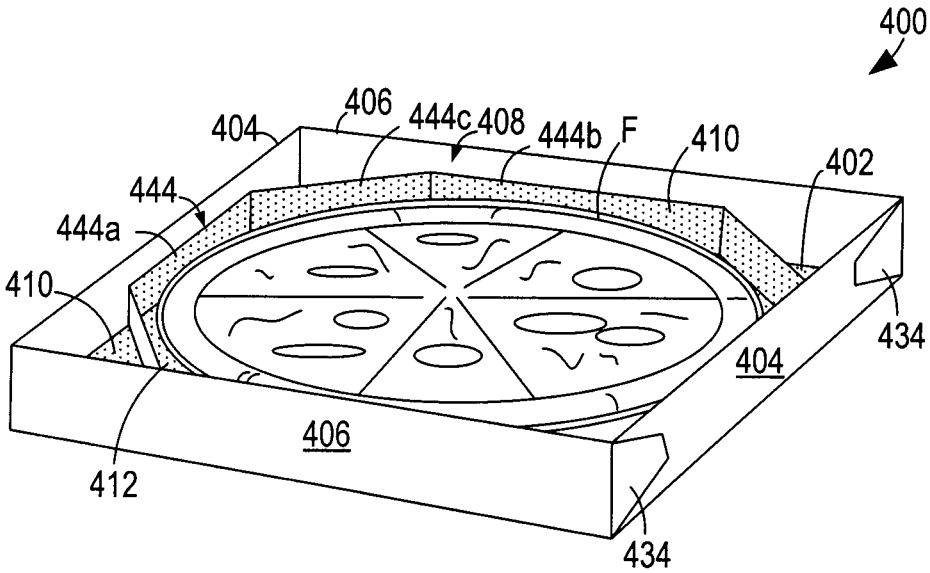
FIG. 4A is a schematic perspective view of still another exemplary microwave heating construct, containing a food item.
Figure 4B:
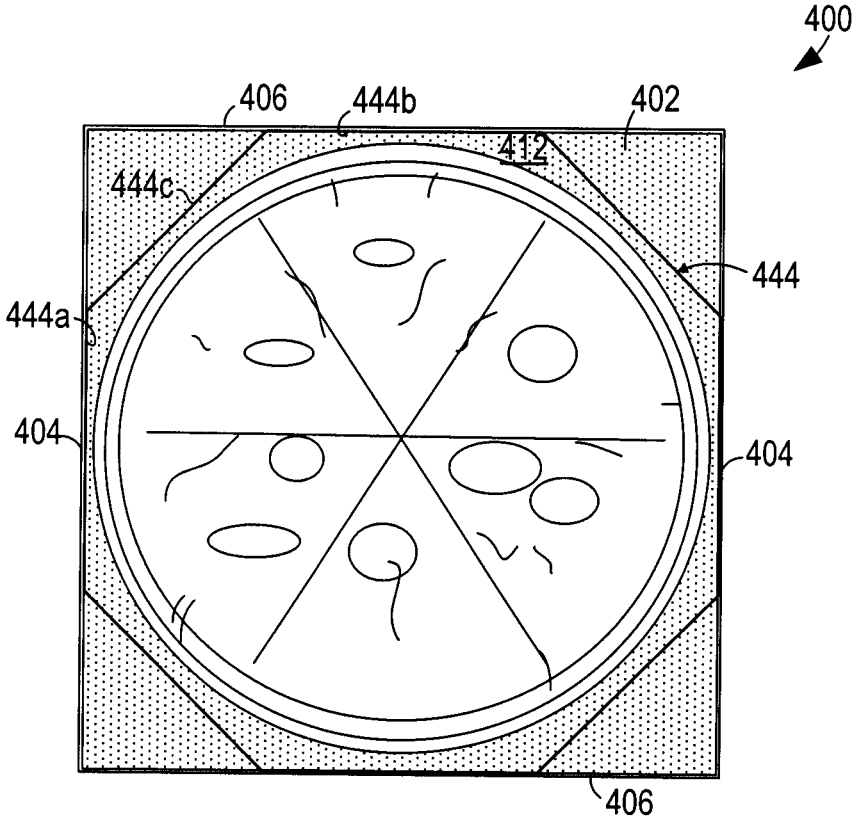
FIG. 4B is a schematic top plan view of the microwave heating construct of FIG. 4A, containing a food item.

In the exemplary construct 400 shown in FIGS. 4A and 4B, the movable portions 114 of the base 102 and the susceptor 110 on the walls 104, 106 of the construct 100 of FIG. 1A are omitted and replaced with a susceptor "ring" 444, for example, a series of susceptors 410 or susceptor panels that are joined end to end (or the like) that generally surround the periphery of the food item F.

The susceptor ring 444 allows the susceptor 410 to be brought into closer proximity with the sides of the food item F, as compared, for example, with the constructs 200, 300 of FIGS. 2A and 3A. As a result, the browning and/or crisping of the food item F may be improved. In this example, the susceptor ring 444 has a generally octagonal shape. However, it will be appreciated that the susceptor ring 444 may include additional panels or walls, and that the greater number of panels or walls, the closer the ring approaches the shape of a circular ring.

In one aspect, side walls 404, 406 may generally be thought of as exterior walls for the construct, and the various portions of the susceptor ring 444 may generally define interior walls for being adjacent to the periphery of the food item. If desired, the susceptor ring 444 may be attached to one or more of the walls 404, 406 (adhesively, mechanically, or otherwise) to maintain the ring 444 in position. Alternatively, the ring 444 may be a separate component that may be removed if desired after the food item F is heated. Numerous other shapes and configurations for the ring 444 are contemplated.

Thus, in one embodiment, a microwave heating construct 400 may comprise a substantially planar base 402, a plurality of exterior walls 404, 406 extending upwardly from a peripheral edge or periphery of the base 402, and a plurality of interior walls 444, where the base 402 and interior walls 444 define an interior space 408 for receiving a food item F. The plurality of exterior walls 404, 406 may include a first exterior wall (e.g., side wall 404) and a second exterior wall (e.g., side wall 406) that are adjacent to one another. The plurality of interior walls 444 may include a first interior wall 444*a* that extends substantially along a portion of the first exterior wall 404, a second interior wall 444*b* that extends substantially along a portion of the second exterior wall 406, and a third interior wall 406*c* extending obliquely between the first interior wall 404 and the second interior wall 406. The first interior wall 444*a* and the second interior wall 444*b* may be joined respectively to the first exterior wall 404 and the second exterior wall 406, or may remain separate from (i.e., not joined or unjoined) to the walls 404, 406. The plurality of interior walls 444 may include a microwave energy interactive material operative 410 for converting at least a portion of impinging microwave energy into heat.

Countless other microwave energy interactive constructs are contemplated by the disclosure. The constructs may have any suitable shape, for example, circular, oval, triangular, square, rectangular, pentagonal, hexagonal, heptagonal, octagonal, or any other regular or irregular shape. The shape of the construct may be determined by the shape of the food product, and it will be understood that different shapes are contemplated for different food products, for example, sandwiches, pizzas, pastries, doughs, and so forth. Further, it will be appreciated that the elevating features may have any shape as needed or desired. For example, the tab may be oval, rectangular, square, diamond-shaped, trapezoidal, polygonal, or any other regular or irregular shape.

Any of such structures or constructs may be formed from various materials, provided that the materials are substantially resistant to softening, scorching, combusting, or degrading at typical microwave oven heating temperatures, for example, at from about 250° F. to about 425° F. The materials may include microwave energy interactive materials, for example, those used to form susceptors and other microwave energy interactive elements, and microwave energy transparent or inactive materials, for example, those used to form the remainder of the construct.

In the case of a susceptor, the microwave energy interactive material may comprise an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

As stated above, the microwave energy interactive elements (e.g., susceptors 110, 210, 310, 410 and any other microwave energy interactive elements) may be supported on a microwave inactive or transparent substrate (e.g., polymer film 112, 212, 312, 412) for ease of handling and/or to prevent contact between the microwave energy interactive material (e.g., microwave energy interactive material 110, 210, 310, 410) and the food item F. The outermost surface of the polymer film (e.g., polymer film 112, 212, 312, 412) may define at least a portion of the food-contacting surface of the package (e.g., surface 112, 212, 312, 412). Examples of polymer films that may be suitable include, but are not limited to, polyolefins, polyesters, polyamides, polyimides, polysulfones, polyether ketones, cellophanes, or any combination thereof. In one particular example, the polymer film comprises polyethylene terephthalate. The thickness of the film generally may be from about 35 gauge to about 10 mil. In each of various examples, the thickness of the film may be from about 40 to about 80 gauge, from about 45 to about 50 gauge, about 48 gauge, or any other suitable thickness. Other non-conducting substrate materials such as paper and paper laminates, metal oxides, silicates, cellulosics, or any combination thereof, also may be used.

If desired, the polymer film may undergo one or more treatments to modify the surface prior to depositing the microwave energy interactive material onto the polymer film. By way of example, and not limitation, the polymer film may undergo a plasma treatment to modify the roughness of the surface of the polymer film. While not wishing to be bound by theory, it is believed that such surface treatments may provide a more uniform surface for receiving the microwave energy interactive material, which in turn, may increase the heat flux and maximum temperature of the resulting susceptor structure. Such treatments are discussed in U.S. Patent Application Publication No. US 2010/0213192, published Aug. 26, 2010, which is incorporated by reference herein in its entirety.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth.

If desired, the susceptor may be used in conjunction with other microwave energy interactive elements and/or structures. Structures including multiple susceptor layers are also contemplated.

For example, the construct may include a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas (e.g., microwave energy transparent areas 342) to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas must be balanced to attain the desired overall heating characteristics for the particular food item. In some embodiments, one or more portions of the susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor. By way of example, the susceptor may incorporate one or more "fuse" elements that limit the propagation of cracks in the susceptor structure, and thereby control overheating, in areas of the susceptor structure where heat transfer to the food is low and the susceptor might tend to become too hot. The size and shape of the fuses may be varied as needed. Examples of susceptors including such fuses are provided, for example, in U.S. Pat. No. 5,412,187, U.S. Pat. No. 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

In the case of a susceptor, any of such discontinuities or apertures may comprise a physical aperture or void (e.g., apertures 124, 224, 324, 424 (not visible in FIGS. 4A and 4B)) in one or more layers or materials used to form the structure or construct, or may be a non-physical "aperture" (e.g., microwave energy transparent area 342)). A non-physical aperture is a microwave energy transparent area (e.g., microwave energy transparent area 342) that allows microwave energy to pass through the structure without an actual void or hole cut through the structure. Such areas may be formed by simply not applying microwave energy interactive material to the particular area, by removing microwave energy interactive material from the particular area, or by mechanically deactivating the particular area (rendering the area electrically discontinuous). Alternatively, the areas may be formed by chemically deactivating the microwave energy interactive material in the particular area, thereby transforming the microwave energy interactive material in the area into a substance that is transparent to microwave energy (i.e., microwave energy inactive). While both physical and non-physical apertures allow the food item to be heated directly by the microwave energy, a physical aperture also provides a venting function to allow steam or other vapors or liquid released from the food item to be carried away from the food item.

For each of the embodiments of FIGS. 1A-4B, the susceptor film (e.g., see the susceptor film 138 of FIG. 1D) and/or other microwave energy interactive elements may be joined to a paper or paperboard base layer or support (e.g., see the base layer 140 of FIG. 1D) that may impart dimensional stability to the structure. The paper may have a basis weight of from about 15 to about 60 lb/ream (lb/3000 sq. ft.), for example, from about 20 to about 40 lb/ream, for example, about 25lb/ream. The paperboard may have a basis weight of from about 60 to about 330 lb/ream, for example, from about 80 to about 140 lb/ream. The paperboard generally may have a thickness of from about 6 to about 30 mils, for example, from about 12 to about 28 mils. In one particular example, the paperboard has a thickness of about 14 mils. Any suitable paperboard may be used, for example, a solid bleached sulfate board, for example, Fortress® board, commercially available from International Paper Company, Memphis, Tenn., or solid unbleached sulfate board, such as SUS® board, commercially available from Graphic Packaging International, Marietta, Ga.

The package may be formed according to numerous processes known to those in the art, including using adhesive bonding, thermal bonding, ultrasonic bonding, mechanical stitching, or any other suitable process. Any of the various components used to form the package may be provided as a sheet of material, a roll of material, or a die cut material in the shape of the package to be formed (e.g., a blank).

While the present invention is described herein in detail in relation to specific aspects and embodiments, it is to be understood that this detailed description is only illustrative and exemplary of the present invention and is made merely for purposes of providing a full and enabling disclosure of the present invention and to set forth the best mode of practicing the invention known to the inventors at the time the invention was made. The detailed description set forth herein is illustrative only and is not intended, nor is to be construed, to limit the present invention or otherwise to exclude any such other embodiments, adaptations, variations, modifications, and equivalent arrangements of the present invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other. Further, various elements discussed with reference to the various embodiments may be interchanged to create entirely new embodiments coming within the scope of the present invention.

What is claimed is:

1. A microwave heating construct for preparing a food item having a periphery that is desirably browned and/or crisped, the construct comprising:

a substantially planar base;

a plurality of side walls extending upwardly from a periphery of the base, the base and side walls defining an interior space for receiving the food item, wherein the base includes a plurality of oblique fold lines and a plurality of movable portions, each movable portion is at least partially defined by an oblique fold line of the plurality of oblique fold lines and a tear line of a plurality of tear lines, each movable portion is configured for being moved out of the plane of the base into the interior space towards the periphery of the food item, comprising each movable portion being pivotably connected to a remainder of the base by an oblique fold line of the plurality of oblique fold lines, and the base and the movable portions comprises microwave energy interactive material that is operative for converting at least a portion of impinging microwave energy into heat.

2. The construct of claim 1, wherein the construct is configured so that moving the movable portions out of the plane of the base into the interior space defines a plurality of venting apertures extending through the base.

3. The construct of claim 1, wherein:

the base includes the plurality of tear lines; and the plurality of tear lines is a plurality of oblique tear lines, so that each movable portion is at least partially defined by an oblique fold line of the plurality of oblique fold lines, the oblique fold line extending substantially between a pair of adjacent side walls of the plurality of side walls, and an oblique tear line of the plurality of oblique tear lines, the oblique fold line extending substantially between the pair of adjacent side walls.

4. The construct of claim 3, wherein for each movable portion of the plurality of movable portions, the movable portion is further defined by lines of disruption extending substantially between respectively adjacent endpoints of the oblique fold and tear lines that partially define the movable portion.

5. The construct of claim 4, wherein the lines of disruption extending substantially between respectively adjacent endpoints lie substantially along the periphery of the base.

6. The construct of claim 4, wherein the lines of disruption extending substantially between respectively adjacent endpoints comprise tear lines.

7. The construct of claim 4, wherein the movable portions are substantially trapezoidal in shape.

8. The construct of claim 3, further comprising a second plurality of tear lines, so that each movable portion is at least partially defined by an oblique fold line of the plurality of oblique fold lines, an oblique tear line of the plurality of oblique tear lines, and a second tear line of the second plurality of tear lines, wherein:

the plurality of side walls includes a first side wall connected to the base at a first fold line; and for a movable portion of the plurality of movable portions, the second tear line that partially defines the movable portion is collinear with the first fold line.

9. The construct of claim 8, further comprising a third plurality of tear lines, so that each movable portion is at least partially defined by an oblique fold line of the plurality of oblique fold lines, an oblique tear line of the plurality of oblique tear lines, a second tear line of the second plurality of tear lines, and a third tear line of the third plurality of tear lines, wherein:

the plurality of side walls further includes a second side wall connected to the base at a second fold line; and for the movable portion of the plurality of movable portions, the third tear line that partially defines the movable portion is collinear with the second fold line.

10. The construct of claim 1, wherein the base is substantially square in shape and the movable portions are disposed adjacent to corners of the base.

11. The construct of claim 1, wherein the microwave energy interactive material is further joined to at least a portion of the side walls.

12. The construct of claim 1, wherein:

the plurality of side walls includes a first side wall connected to the base at a first fold line; and for a movable portion of the plurality of movable portions, the tear line that partially defines the movable portion is collinear with the first fold line.

13. A blank for forming a microwave heating construct, the blank comprising:

a plurality of adjoined panels, the plurality of adjoined panels each having a first dimension extending in a first direction and a second dimension extending in a second direction substantially perpendicular to the first direction, the plurality of adjoined panels including a base panel, a first side panel joined to the base panel along a first fold line, the first fold line extending in the first direction, and a second side panel joined to the base panel along a second fold line, the second fold line extending in the second direction, wherein the base panel includes a pair of lines of disruption extending obliquely substantially from the first side panel to the second side panel, the pair of lines of disruption at least partially defining a movable portion of the base panel, the pair of lines of disruption comprising an oblique fold line an oblique tear line, the movable portion being pivotably connected to a remainder of the base panel by the oblique fold line; and a microwave energy interactive material joined to at least a portion of both the remainder of the base panel and the movable portion, the microwave energy interactive material being operative for converting at least a portion of impinging microwave energy into heat.

14. The blank of claim 13, wherein the movable portion is further defined by a third line of disruption and a fourth line of disruption respectively extending substantially between adjacent ends of the oblique fold line and the oblique tear line.

15. The blank of claim 14, wherein the third line of disruption extends substantially along the first fold line joining the first side panel to the base panel, and the fourth line of disruption extends substantially along the second fold line joining the second side panel to the base panel.

16. The blank of claim 14, wherein the third line of disruption and the fourth line of disruption each comprise a tear line.

17. The blank of claim 14, wherein the movable portion is substantially trapezoidal in shape.

18. The blank of claim 14, wherein the third line of disruption comprises a fold line that is collinear with the first fold line joining the first side panel to the base panel, and the fourth line of disruption comprises a fold line that is collinear with the second fold line joining the second side panel to the base panel.

19. The blank of claim 13, wherein the base panel is substantially square in shape and the movable portion is disposed adjacent to a first corner of the base panel.

20. The blank of claim 13, wherein the plurality of adjoined panels further includes a third side panel joined to the base panel along a third fold line, the third fold line extending in the first direction, and a fourth side panel joined to the base panel along a fourth fold line, the fourth fold line extending in the second direction.

21. The blank of claim 13, wherein the movable portion is a first movable portion of a plurality of movable portions of the base panel.

22. The blank of claim 13, wherein the microwave energy interactive material is further joined to at least a portion of the side panels.

23. A microwave heating construct, comprising:

a substantially planar base;

a plurality of exterior walls extending upwardly from a periphery of the base, the plurality of exterior walls including a first exterior wall and a second exterior wall, the first exterior wall and the second exterior wall being adjacent to one another, wherein the base and the exterior walls at least partially define a first interior space; and a plurality of interior walls positioned in the first interior space, the base and interior walls defining a second interior space for receiving a food item, the plurality of interior walls including a microwave energy interactive material operative for converting at least a portion of impinging microwave energy into heat, wherein the plurality of interior walls includes a first interior wall that extends substantially along a portion of the first exterior wall, a second interior wall that extends substantially along a portion of the second exterior wall, and a third interior wall extending obliquely between the first interior wall and the second interior wall.

24. The construct of claim 23, wherein the first interior wall and the second interior wall are joined respectively to the first exterior wall and the second exterior wall.

25. The construct of claim 23, wherein the first interior wall and the second interior wall are not joined to the first exterior wall and the second exterior wall.

26. The construct of claim 23, wherein the plurality of interior walls defines a microwave energy interactive ring for surrounding the periphery of a food item.

27. The construct of claim 23, wherein the base includes a microwave energy interactive material operative for converting at least a portion of impinging microwave energy into heat.

28. A blank for forming a microwave heating construct, the blank comprising:

a base panel;

a plurality of side panels connected to and extending from a periphery of the base panel, wherein the base panel includes a plurality of oblique fold lines and a plurality of movable portions, each movable portion is at least partially defined by an oblique fold line of the plurality of oblique fold lines and a tear line of a plurality of tear lines, each movable portion is configured for being moved out of the plane of the base panel, comprising each movable portion being pivotably connected to a remainder of the base panel by an oblique fold line of the plurality of oblique fold lines, and the movable portions comprise microwave energy interactive material that is operative for converting at least a portion of impinging microwave energy into heat.

29. The blank of claim 28, wherein:

the base panel includes the plurality of tear lines; and the plurality of tear lines is a plurality of oblique tear lines, so that each movable portion is at least partially defined by an oblique fold line of the plurality of oblique fold lines, the oblique fold line extending substantially between a pair of adjacent side panels of the plurality of side panels, and an oblique tear line of the plurality of oblique tear lines, the oblique fold line extending substantially between the pair of adjacent side panels.

30. The blank of claim 29, further comprising a second plurality of tear lines, so that each movable portion is at least partially defined by an oblique fold line of the plurality of oblique fold lines, an oblique tear line of the plurality of oblique tear lines, and a second tear line of the second plurality of tear lines, wherein:

the plurality of side panels includes a first side panel connected to the base panel at a first fold line; and for a movable portion of the plurality of movable portions, the second tear line that partially defines the movable portion is collinear with the first fold line.

31. The blank of claim 30, further comprising a third plurality of tear lines, so that each movable portion is at least partially defined by an oblique fold line of the plurality of oblique fold lines, an oblique tear line of the plurality of oblique tear lines, a second tear line of the second plurality of tear lines, and a third tear line of the third plurality of tear lines, wherein:

the plurality of side panels further includes a second side panel connected to the base panel at a second fold line; and for the movable portion of the plurality of movable portions, the third tear line that partially defines the movable portion is collinear with the second fold line.

* * * * *